United States Patent [19]

Kronich

[11] Patent Number: 4,601,267

[45] Date of Patent: Jul. 22, 1986

[54] VALVE MECHANISM LUBRICATION SYSTEM FOR AN OVERHEAD VALVE ENGINE

[75] Inventor: Peter G. Kronich, Sheboygan, Wis.

[73] Assignee: Tecumseh Products Company, Tecumseh, Mich.

[21] Appl. No.: 759,659

[22] Filed: Jul. 26, 1985

[51] Int. Cl.[4] ..... F01M 13/00; F01M 11/02

[52] U.S. Cl. ..... 123/90.33; 123/41.86; 123/90.35; 123/90.38; 123/572

[58] Field of Search ..... 123/90.33, 90.35, 90.37, 123/90.38, 196 CP, 572, 41.86

[56] References Cited

U.S. PATENT DOCUMENTS

| | | | |
|---|---|---|---|
| 1,682,998 | 3/1925 | Summers | 123/41.86 |
| 2,111,828 | 3/1938 | Weaver et al. | 123/90.35 |
| 2,366,701 | 1/1945 | Doman | 123/90.35 |
| 2,381,339 | 8/1945 | Doman | 123/90.35 |
| 2,657,679 | 9/1951 | Powell | 123/90.38 |
| 2,963,012 | 12/1960 | Kolbe | 123/90.33 |
| 2,974,652 | 3/1961 | Benzinger | 123/41.86 |
| 3,135,254 | 6/1964 | Hulten | 123/90.33 |
| 3,456,759 | 7/1969 | Henry-Biabaud | 123/90.38 |
| 4,470,389 | 9/1984 | Mitadera et al. | 123/196 CP |
| 4,517,951 | 5/1985 | Otaka et al. | 123/572 |

*Primary Examiner*—Ira S. Lazarus

*Attorney, Agent, or Firm*—Albert L. Jeffers; Anthony Niewyk

[57] ABSTRACT

In an internal combustion engine a breather induced valve lifter mechanism lubricating system wherein oil mist is conducted from the crankcase through one push rod tube to the rocker box. The oil mist is caused to flow around the valve actuating mechanism by a baffle before flowing out of the rocker box through a second push rod tube to the breather chamber. Oil which condenses in the rocker box flows through the second push rod tube to the breather chamber. Oil which collects in the breather chamber will be caused to flow through a drainage passage from the breather chamber to the oil sump in the crankcase.

15 Claims, 4 Drawing Figures

VALVE MECHANISM LUBRICATION SYSTEM FOR AN OVERHEAD VALVE ENGINE

BACKGROUND OF THE INVENTION

This invention relates to a breather induced lubrication system for the upper valve mechanism of an overhead valve, single cylinder, four stroke, internal combustion engine.

Prior art horizontal crankshaft engines having included breather induced upper valve mechanism lubrication systems wherein the breather was located on top of the rocker box and wherein oil mist was induced to flow upwardly by the breather from the crankcase through both push rod tubes to the rocker box chamber to lubricate the valve actuating mechanism in the rocker box. Oil which condensed in the rocker box was drained back downwardly along the sidewalls of the push rod tubes to the crankcase.

In vertical crankshaft engines the above described breather induced lubrication system does not perform satisfactorily due to several problems. First of all, when the engine is oriented in the head down attitude, oil will not drain from the rocker box to the oil sump thus causing oil to build up in the rocker box. As enough oil builds up the breather will pump oil from the rocker box to the exterior of the engine. This is unsatisfactory because of oil spillage on and around the engine and the loss of lubricating oil which can result in engine failure due to lack of lubrication.

One solution to the above problems is to use a scavenging pump to remove the liquid oil from the rocker box and thereby prevent the build up of liquid oil therein. However, the provision of such a pump adds to the cost of the engine which is unsatisfactory.

Some prior art valve mechanism lubricating structures have been provided whereby liquid oil is pumped from the crankcase through a push rod tube to the valve rocker mechanism whereby the valve rockers operate to splash oil over the moveable members of the rocker arms and bearings. Excess oil is drained out of the rocker chamber through a push rod tube to return to the crankcase. Such systems are unsatisfactory because of the cost of providing the required oil pumping mechanism and furthermore because a separate breather mechanism is required to vent the crankcase.

It is therefore desired to provide a simple, effective valve mechanism lubrication system whereby lubrication is induced by the breather. It is furthermore desired to provide a valve lifter actuation mechanism whereby oil mist in the crankcase is induced by the breather to flow past and thereby lubricate the rocker mechanism, then to be conducted to the breather for venting to the atmosphere, wherein condensed oil is drained back to the oil sump.

SUMMARY OF THE INVENTION

The present invention overcomes the disadvantages of the above described prior art lubrication systems by providing an improved breather induced lubrication system therefor.

The invention, in one form thereof, provides an internal combustion engine valve lifter mechanism lubricating system wherein one push rod tube conducts oil mist from the crankcase to the rocker box and a second push rod tube conducts oil mist and condensed liquid oil from the rocker box to a breather chamber. The breather chamber is vented through a breather valve mechanism to the atmosphere and is also connected by a drain passage to the oil sump. Liquid oil drains from the breather chamber to the oil sump through the drain passage.

The present invention, in one form thereof, provides a loop circuit from the crankcase to the oil sump whereby oil mist is induced to flow by the breather toward the rocker box through one push rod tube and is then caused to flow over the valve actuating mechanism by means of a baffle which is located in the rocker box. Oil mist and condensed liquid oil are then induced to flow from the rocker box toward the breather chamber through a second push rod tube. The breather chamber is vented through a valve mechanism to the atmosphere. Liquid oil collected in the breather chamber will drain back to the oil sump due to the greater pressure in the breather as compared to the low pressure generated in the crankcase.

Another advantage of the lubrication system according to the present invention is that the valve rocker mechanism is lubricated without the need for additional pumps to pump oil from the sump to the rocker box nor requires a scavenging pump to remove the oil from the rocker box when used in the horizontal cylinder mode with the crankshaft in a vertical position.

A still further advantage of the present invention is that engines incorporating the lubrication system of the present invention may be oriented in head down attitudes without causing oil to be pumped out of the breather.

Yet another advantage of the present invention is that it is simple in construction and low in cost yet very effective in lubricating the valve lifter mechanism.

The invention, in one form thereof, comprises a lubrication system for the valve actuating mechanism of an internal combustion engine which includes a crankcase, a breather chamber and a rocker box for housing the valve actuating mechanism. A first hollow push rod tube which houses a first push rod has one end open to the crankcase and an opposite end open to the rocker box whereby oil mist is conducted from the crankcase to the rocker box for lubrication of the valve actuating mechanism. A second hollow push rod tube which houses a second push rod has one end open to the rocker box and an opposite end open to the breather chamber for conducting oil mist and liquid oil from the rocker box to the breather chamber. The breather box includes a breather chamber and vent for venting the breather chamber to the atomsphere. A drain is provided for draining liquid oil which collects in the breather chamber to the oil sump.

It is an object of the present invention to provide a valve lifter mechanism lubrication system whereby oil mist is caused to flow from the crankcase in a loop circuit to lubricate the valve lifter mechanism and whereby liquid oil is induced by the breather to drain back from the valve lifter mechanism to the crankcase.

It an another object of the present invention to provide a breather induced valve lifter mechanism lubrication system whereby an engine incorporating the system and with the breather on top of the rocker cover may be oriented in head-down attitude without causing oil to be pumped through the breather out of the engine.

Yet another object of the present invention is to provide a valve lifter lubrication system which is economical and effective.

BRIEF DESCRIPTION OF THE DRAWINGS

The above mentioned and other features and objects of this invention and the manner of attaining them will become more apparent and the invention itself will be better understood by reference to the following description of an embodiment of the invention taken in conjunction with the accompanying drawings, wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DESCRIPTION OF THE PREFERRED EMBODIMENT

Figure 1:
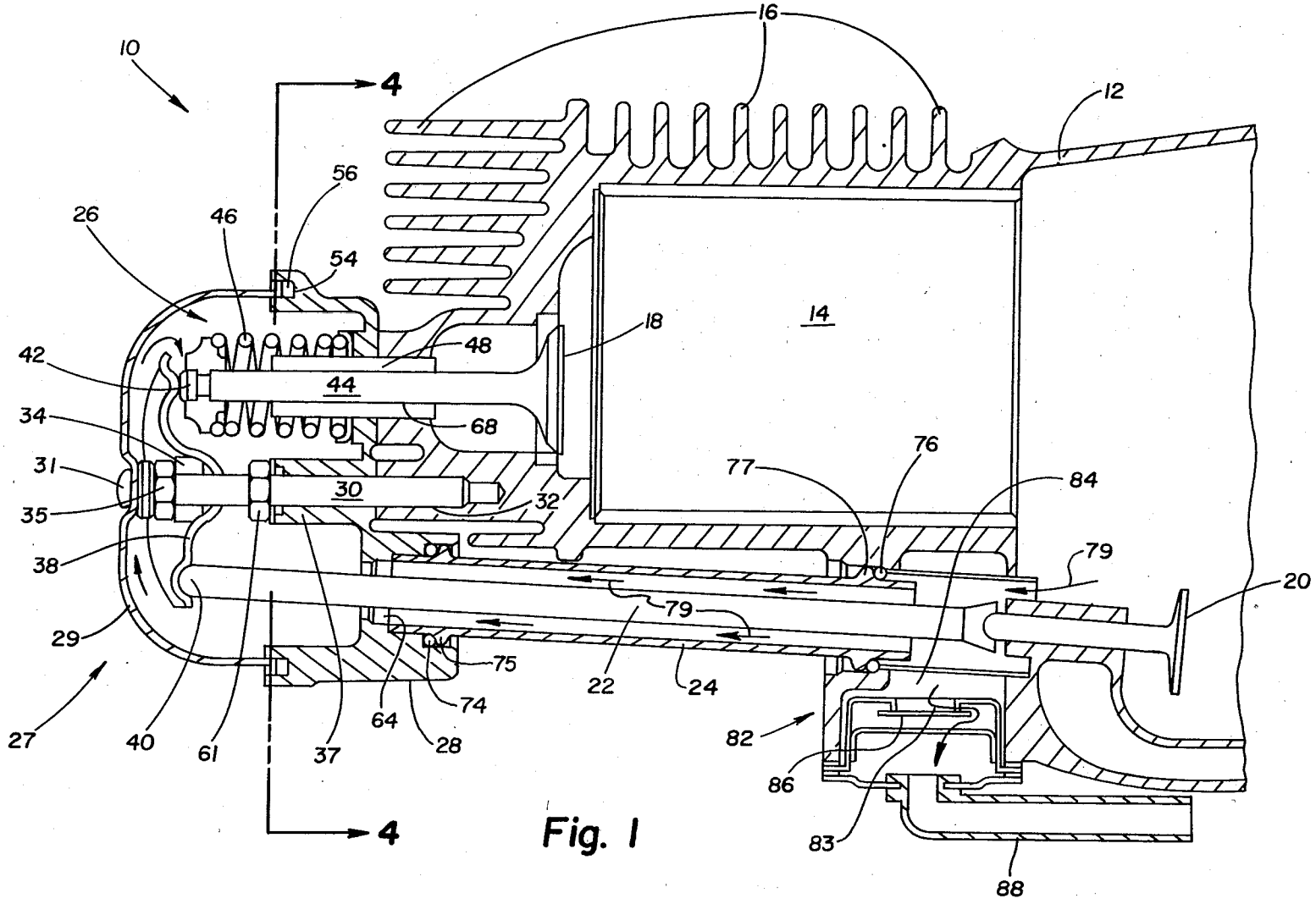
FIG. 1 is a plan view in cross section of the valve actuation and breather system.
Figure 2:
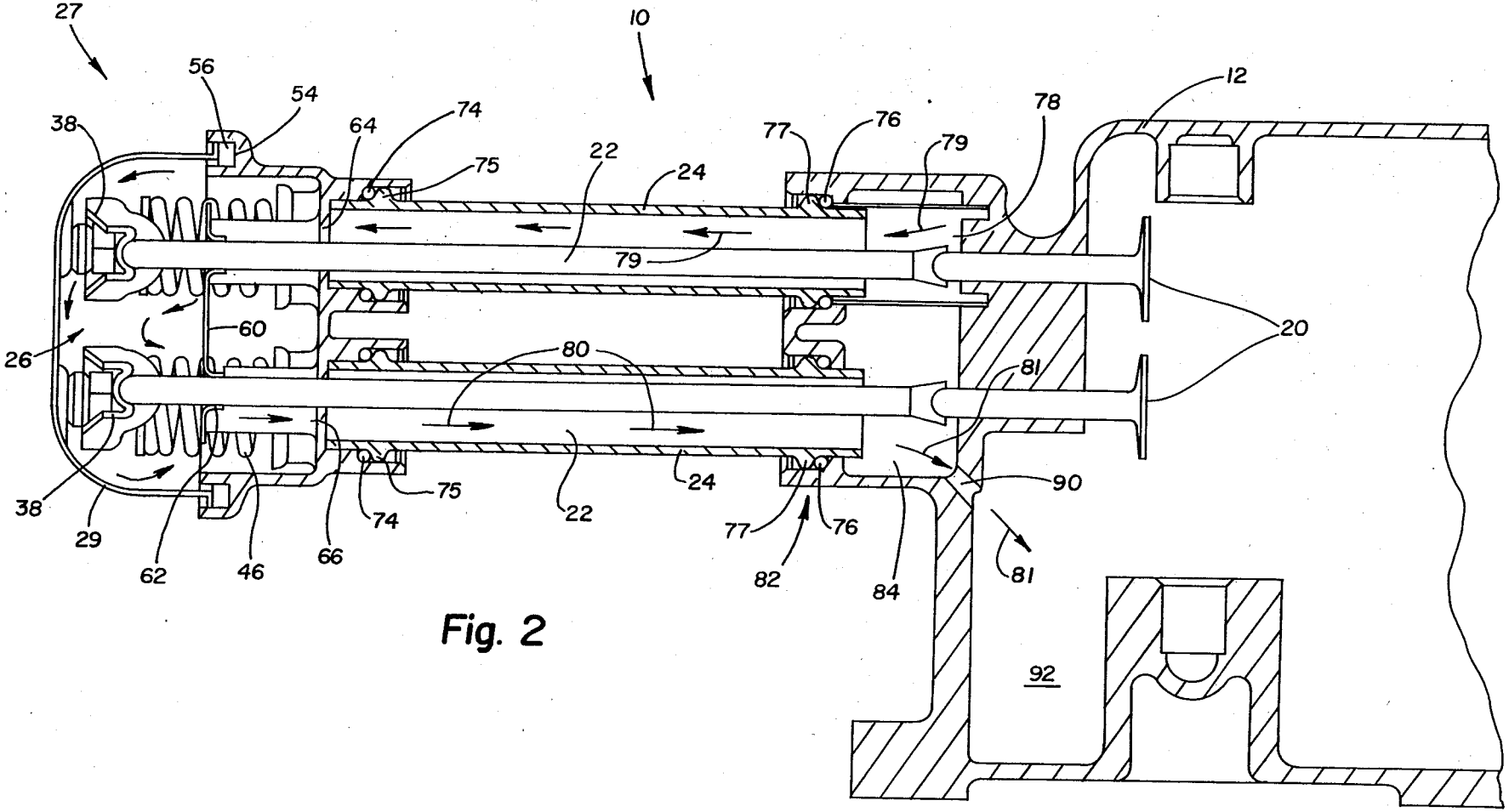
FIG. 2 is an elevational sectional view of the valve actuation and breather system of FIG. 1.

Referring now to FIGS. 1 and 2 an engine 10 is shown including a crankcase 12 and a cylinder 14. The engine includes cooling fins 16 disposed around cylinder 14. A valve 18 in cylinder 14 operates in a conventional manner to selectively permit entry of fuel into cylinder 14 as is conventional. Another valve (not shown) is provided for exhausting combustion products from cylinder 14. A valve actuating mechanism is shown including a tappet 20 which is operated by a cam and a cam shaft (not shown) in a conventional manner. The tappet operates on a push rod 22 which is reciprocably housed in a push rod tube 24. As best seen in FIG. 2 two valve actuating mechanisms are provided for the inlet and exhaust valves 18 respectively.

A valve rocker mechanism 26 is housed in a rocker box 27 comprised of a rocker box base 28 and a rocker box cover 29. The rocker box cover 29 is retained on the rocker box base 28 by means of two fasteners 31 which engage with two threaded shafts 30 received in threaded apertures 32 in bushings 37 of crankcase 12. Fasteners 31 are threaded into apertures in the ends of shafts 30. Rockers 38 are retained on shafts 30 by means of washers 34 and nuts 35 whereby rockers 38 can rock or pivot in response to actuation of push rods 22 by tappets 20. Therefore as push rods 22 are actuated by tappets 20, the actuating ends 40 of push rods 22 will operate on rockers 38 to cause rockers 38 to pivot and thereby actuate valve stems 44 of valves 18. Springs 46 are provided for biasing valves 18 into their normally closed positions. Valve stem bushings 48 operate as bearings for stems 44 and as guides for valve springs 46.

Figure 4:
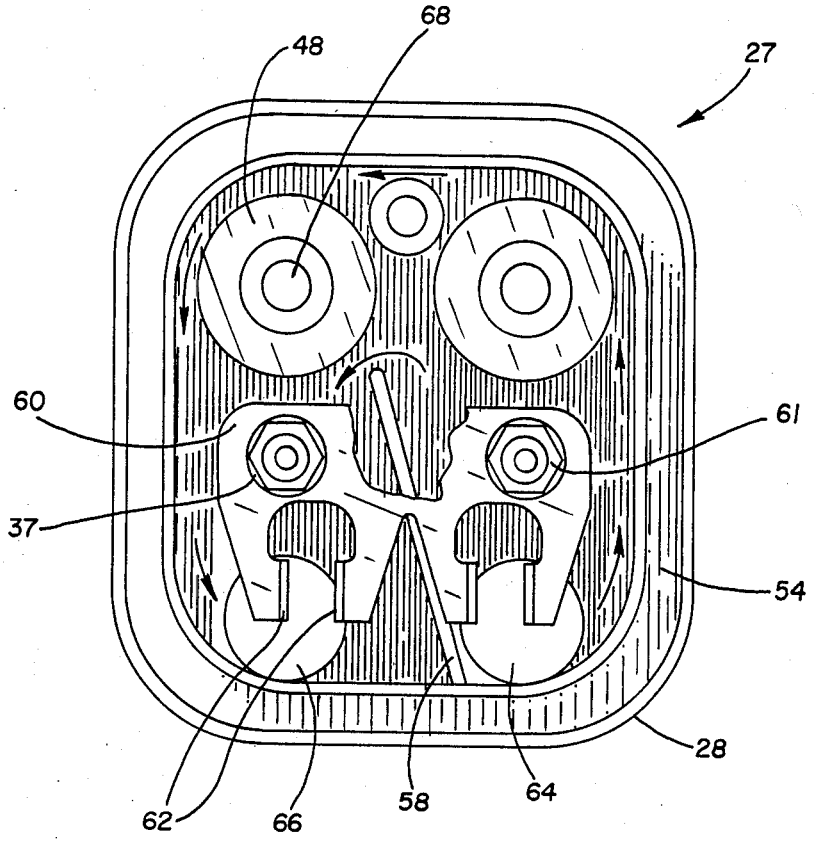
FIG. 4 is an enlarged sectional end view of the rocker box and valve actuating mechanism taken along line 4—4 of FIG. 1.

By referring to FIG. 4 it can be seen that rocker box base 28 includes a groove 54 into which a flanged portion of rocker box cover 29 is retained. Additionally a seal 56 is located in groove 54 whereby cover 29 of rocker box 27 is sealingly engaged with base 28 of the rocker box so that no oil mist escapes from rocker box 27 externally of the engine. Rocker box 27 also includes a baffle 58, secured to rocker box base 28. A plate 60 is supported on bushings 37 and retained in place by nuts 61, two of which are provided, and which engage with threaded shafts 30. Plate 60 includes a double pair of upstanding flanges 62 for guiding push rods 22. A pair of apertures 64 and 66 are shown in rocker box base 28 on either side of baffle 58 through which push rods 22 extend from push rod tubes 24 into rocker box 27. Additionally, a pair of apertures 68 are shown in bushings 48 through which valve stems 44 of valves 18 extend into rocker box 27.

Figure 3:
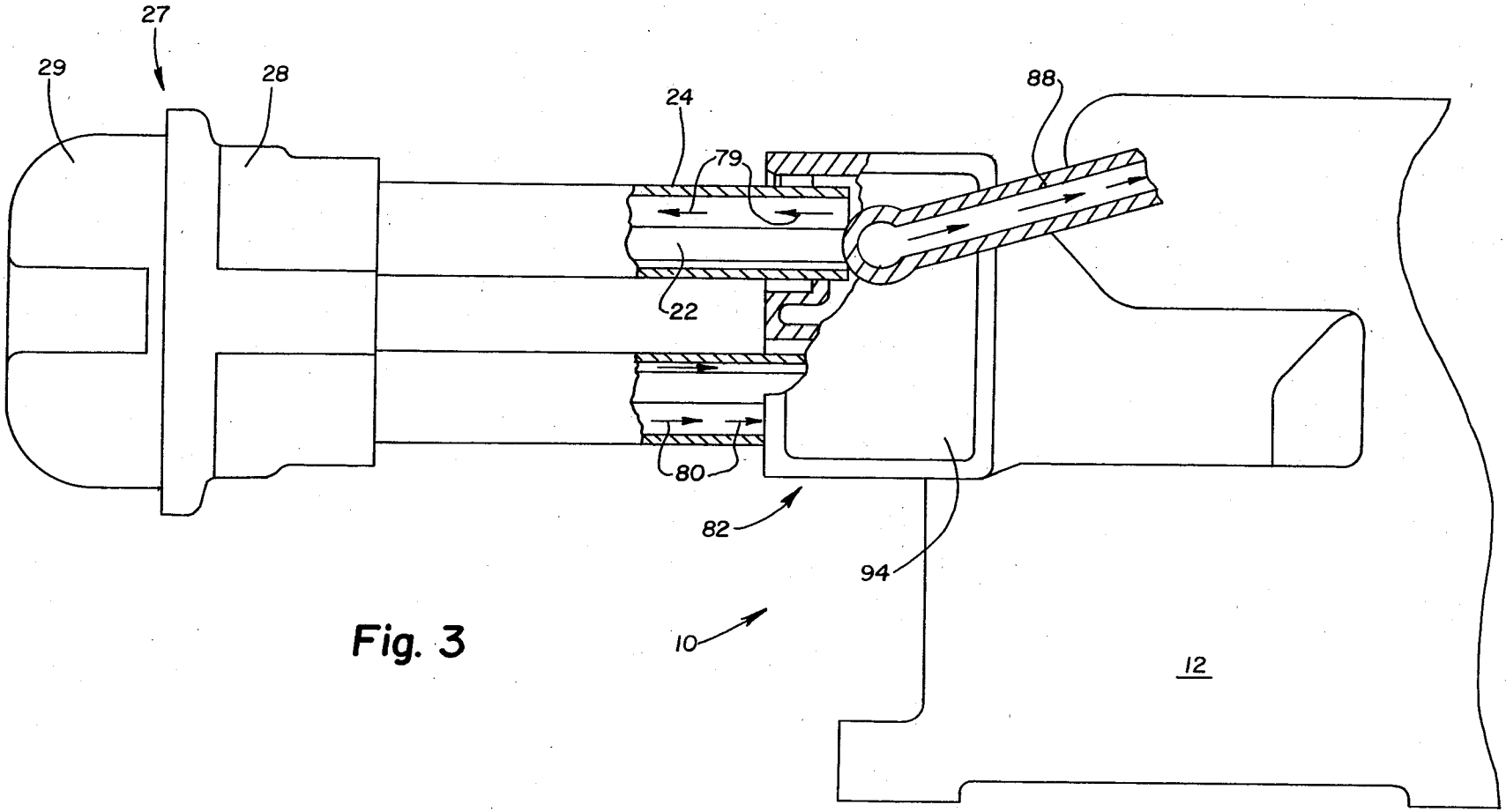
FIG. 3 is a partially broken away elevational view of the valve actuation and breather system of FIG. 1.

Referring again to FIGS. 1 and 2, it can be seen that push rod tubes 24 are sealed to rocker box 27 by means of O-rings 74 and annular flanges 75. Additionally push rod tubes 24 are sealed to crankcase 12 by means of O-rings 76 and annular flanges 77. The upper push rod tube 24, as shown in FIG. 2, is open to the crankcase by means of aperture 78 whereby oil mist can flow from crankcase 12 into upper push rod tube 24 tube as shown by arrows 79. Lower push rod tube 24, as shown in FIG. 2, opens into the interior of a breather 82 comprising a breather chamber 84. Oil mist can therefore travel from rocker box 27 to breather chamber 84 as shown by arrows 80. Breather 82 also includes a disc valve 86 as best shown in FIG. 1, whereby breather chamber 84 is vented to the atmosphere through disc valve 86 and vent tube 88 as best shown in FIGS. 1 and 3. Breather chamber 84 communicates with an oil sump 92 in crankcase 12 by means of a drain passage 90. Breather chamber 84 is closed by means of a breather cover 94.

The disc valve 86 comprises a check valve whereby the breather chamber is vented to the atmosphere and pressures in crankcase 12 above atmospheric pressure are relieved through breather 82 as shown by arrow 83. However, when the crankcase pressure goes slightly below atmospheric pressure by operation of the piston in cylinder 14, check valve 86 will close off breather chamber 84 thereby preventing a flow of air into breather chamber 84 from the ambient atmosphere. The provision of drain passage 90 in crankcase 12 will assist liquid oil, which collects in chamber 84, to drain therefrom and through conduit 90 into oil sump 92 when the crankcase pressure falls below atmospheric pressure, since the pressure in breather chamber 84 is normally at substantially atmospheric pressure. Liquid oil will therefore be aided in draining through drain passage 90 into oil sump 92 as shown by arrows 81. Oil drain passage 90 is preferably made rather small whereby a difference of pressure may exist across passage 90 without rapid pressure equalization between chamber 84 and oil sump 92.

In operation, when the engine piston is in its downward stroke in cylinder 14 and compresses the gas in crankcase 12, crankcase oil mist will travel out of the crankcase 12 through aperture 78 and through upper push rod tube 24 as shown in FIG. 2 and aperture 64 into rocker box 27. The oil mist which enters rocker box 27 will be forced by baffle 58, as best shown in FIG. 4, to flow past the valve actuating mechanism 26 for lubrication thereof as shown by the arrows. Without baffle 58 the oil mist would shortcircuit the valve mechanism 26 and would flow directly from inlet 64 to outlet 66 without contacting mechanism 26. Since rocker mechanism 26 is cooler than the oil mist, some of the oil mist will condense in the rocker box. This condensed oil mist will drain through lower push rod tube 24 into breather chamber 84. Additionally, the remaining oil mist in rocker box 27 will travel through lower push rod tube 24, as indicated by arrows 80, to the breather chamber 84. As shown by arrow 83 some oil mist will be vented out of breather chamber 84 to the atmosphere when the pressure in breather 82 exceeds atmospheric pressure. Liquid oil which collects in breather chamber 84 will drain to oil sump 92 by means of drain passage 90 as shown by arrows 81. This draining action occurs because of pressure differential across drain passage 90 during the upward stroke of the piston which tends to create a vacuum in the crankcase.

What has therefore been shown is a breather induced lubrication system for an engine valve actuating mechanism whereby the valve actuation mechanism is lubricated by inducement from the breather as oil mist will flow in a loop circuit from crankcase 12 through push rod tubes 24 and the rocker box 27 to lubricate the valve actuating mechanism 26 therein and will then return to the breather 82 for venting to the atmosphere by vent tube 88. Condensed oil in breather 82 will drain back to oil sump 92.

While this invention has been described as having a preferred design it will be understood that it is capable of further modification. This application is therefore intended to cover any variations, uses or adaptations of the invention following the general principles thereof and including such departures from the present disclosure as come within known or customary practice in the art to which this invention pertains and fall within the limits of the appended claims.

What is claimed is:

1. In an internal combustion engine, including a crankcase, an oil sump, a plurality of push rods for operating the valves of the engine, a rocker box for housing the valve actuating mechanism, a lubrication system for lubricating the valve actuating mechanism comprising:

a first hollow tube for housing a first of said push rods, said first tube having one end open to said crankcase, and an opposite end open to said rocker box, for conducting oil mist from said crankcase to said rocker box to lubricate said valve rocker mechanism;

a second hollow tube for housing a second said push rod, said second tube having one end open to said rocker box and an opposite end open to a breather chamber for conducting liquid oil and oil mist from said rocker box to said breather chamber, said breather chamber being vented to the atmosphere;

an oil drain passage for conducting liquid oil from said breather chamber to said oil sump; and baffle means in said rocker box for causing said oil mist entering said rocker box from said first tube to flow past said valve actuating mechanism for lubrication thereof before flowing from said rocker box into said second tube.

2. The lubrication system of claim 1 including a check valve in said breather chamber, said valve operative to permit gas flow from said breather chamber to the atomsphere and operative at a predetermined pressure to prevent gas flow from said breather chamber to the atmosphere.

3. The lubrication system of claim 1 and including a vent tube having one end connected to said breather chamber and an opposite end open to the atmosphere.

4. In an internal combustion engine including a crankcase and an oil sump, a valve rocker lubricating system comprising;

a rocker chamber;

a breather chamber vented to the atmosphere;

a first hollow push rod tube connecting said rocker chamber to said crankcase;

a second hollow push rod tube connecting said rocker chamber to said breather chamber; and drain means for draining oil from said breather chamber to said sump.

5. The lubricating mechanism of claim 4 including baffle means in said rocker box for causing oil mist entering said rocker box through said first tube to flow through said valve rocker mechanism for lubrication thereof.

6. The lubrication system of claim 4 wherein said breather chamber is vented to the atmosphere.

7. The lubrication system of claim 6 including a vent tube having one end connected to said breather chamber and the opposite end open to the atmosphere.

8. The lubrication system of claim 4 wherein said drain means comprises a conduit from said breather chamber to said sump.

9. The lubrication system of claim 4 including a check valve in said breather chamber, said valve operative to permit gas flow from said breather to the atmosphere and operative at a predetermined crankcase pressure to prevent gas flow from said chamber to the atmosphere.

10. A lubrication system for the valve actuating mechanism of an internal combustion engine comprising:

a crankcase including an oil sump;

a breather chamber;

a rocker box for housing said valve actuating mechanism;

first hollow push rod tube means for housing a first push rod, said first tube having one end open to said crankcase and an opposite end open to the rocker box whereby oil mist is conducted from said crankcase to said rocker box for lubrication of said valve actuating mechanism;

second hollow push rod tube means for housing a second push rod and having one end open to said rocker box and an opposite end open to said breather chamber for conducting oil mist and liquid oil from said rocker box to said breather chamber;

vent means for venting said breather chamber to the atmosphere; and drain means for draining liquid oil from said breather chamber to said oil sump.

11. The lubrication system of claim 10 including baffle means in said rocker box for directing said oil mist past said valve rocker mechanism as said oil mist flows through said rocker box.

12. The lubrication system of claim 10 wherein said breather chamber is vented to the atmosphere.

13. The lubrication system of claim 10 wherein said drain means comprises a conduit from said breather chamber to said oil sump, the pressure differential across said conduit causing liquid oil to flow from said breather chamber to said sump.

14. The lubrication system of claim 10 including a check valve in said breather chamber, said valve operative to permit gas flow to the atmosphere from said breather chamber and operative at a preselected pressure to prevent gas flow from said breather chamber to the atmosphere.

15. The lubrication system of claim 14 including a vent tube having one end thereof connected to said check valve and the opposite end open to the atmosphere.

* * * * *